US005511242A

United States Patent [19]

Bianchi

[11] Patent Number: 5,511,242

[45] Date of Patent: Apr. 30, 1996

[54] PROTECTIVE SPORTS GLOVE

[76] Inventor: Sandro Bianchi, 39 Oakville Road, Woodbridge, Ontario, Canada, L4L 2H2

[21] Appl. No.: 458,247

[22] Filed: Jun. 2, 1995

[51] Int. Cl.[6] ..... A41D 13/10

[52] U.S. Cl. ..... 2/16; 2/161.1

[58] Field of Search ..... 2/16, 20, 159, 2/161.1, 163

[56] References Cited

U.S. PATENT DOCUMENTS

| | | | |
|---|---|---|---|
| 1,841,193 | 1/1932 | Lidston | 2/16 |
| 3,605,117 | 9/1971 | Latina | 2/16 |
| 3,626,515 | 12/1971 | Murray | 2/16 |
| 3,997,922 | 12/1976 | Huhta . | |
| 4,417,359 | 11/1983 | Johnson | 2/16 |
| 4,497,073 | 2/1985 | Deutsch | 2/16 |
| 4,561,122 | 12/1985 | Stanley et al . | |
| 4,677,698 | 7/1987 | Angas | 2/16 |
| 4,700,404 | 10/1987 | Lesperance | 2/16 |
| 4,930,162 | 6/1990 | Cote | 2/16 |

FOREIGN PATENT DOCUMENTS

| | | | |
|---|---|---|---|
| 3604103 | 8/1986 | Germany | 2/20 |

*Primary Examiner*—Paul C. Lewis
*Attorney, Agent, or Firm*—Mark B. Esen

[57] ABSTRACT

The invention provides a hockey glove in which the flexibility of the fingers is substantially increased without detracting from the protection provided by padding along the back of the glove. Stalls are provided for the fingers in which a portion of each stall is not attached to the padding along the back of the finger, but is isolated from the padding overlaying the stall and only resiliently attached thereto so that when the fingers are flexed the padding follows the flexing motion, but restricts it only minimally. In a preferred embodiment an elastic strap is provided to form a resilient web between the isolated portion of each finger and its associated padding. When the fingers are flexed, the isolated portions of the stalls allow the fingers a greater freedom of movement while the fingers remain protected by the overlying padding because the elastic strap pulls the sections of padding along with the stalls. The thumb stall may optionally be similarly constructed.

9 Claims, 3 Drawing Sheets

PROTECTIVE SPORTS GLOVE

FIELD OF INVENTION

This invention relates to protective equipment. In particular, this invention relates to an improved protective glove for sports such as hockey and the like.

BACKGROUND OF THE INVENTION

Sports such as hockey which entail rough physical contact require special protective equipment. A common protective measure is the use of padded gloves, which typically consist of flexible palm and finger stalls sewed to sections of padding along the back of the hand. This provides significant protection to the player's hands, since the palm side of the hand is generally closed around a hockey stick and therefore not exposed to potentially injurious activity.

However, this also has the undesirable effect of reducing the flexibility of the player's hands, which can significantly impact on the ability to grasp an object such as a hockey stick, puck, ball or the like. Conventional hockey gloves have typically reflected a balance between the maximum thickness and amount of padding, for protection of the hands, and the need for some degree of flexibility or dexterity to enable the player to achieve an acceptable level of performance. Thus, conventional hockey gloves have evolved to utilize sections of padding strategically positioned across the back of the glove, to permit the greatest possible flexibility while still providing the necessary protection.

In practise, however, the dexterity of the player is invariably decreased by the hockey glove. Even though the divisions between sections of padding are located to roughly correspond with the joints in the player's hand, the web of material connecting adjacent sections still reduces flexibility considerably. The alternative, which is to leave large gaps between sections of padding at the points of greatest flexure, is both impractical and dangerous. The joints of the finger are especially prone to injury in a contact sport, and must therefore be well protected, yet it is at these very joints where the largest degree of flexibility for grasping purposes is required. Moreover, it is impractical to separate the padding at the medial-distal joint, resulting in almost no freedom of movement for the distal phalange of the finger, which is important to efficient grasping of an object.

SUMMARY OF THE INVENTION

The present invention overcomes these disadvantages by providing a hockey glove in which the flexibility of the fingers is substantially increased without detracting from the protection provided by padding along the back of the glove. Stalls are provided for the thumb and fingers as in a conventional hockey glove, however the portion of these stalls surrounding the medial and distal phalanges of each finger is not sewn to the padded back of the glove. This portion is isolated from the padded sections along the back of each finger, forming a sheath around the medial and distal phalanges, but is resiliently attached to the padding at the back of the fingers so that when the fingers are flexed the padding follows the flexing motion, but lags slightly behind and thus restricts the ability to flex the fingers only minimally.

This is accomplished by providing an elastic strap between the isolated portion of each finger stall and the associated padded sections along the back of the finger.

When the fingers are flexed, for example to grasp an object such as a hockey stick, the isolated portions of the stalls allow the fingers a greater freedom of movement, similar to a typical unpadded glove, while the fingers remain protected by the overlying padding because the elastic strap pulls the sections of padding along with the stalls. Thus, there is a small separation or gap between this portion of the stalls and the overlying padded sections, which gap increases slightly as the flexure of the fingers and thumb increases. The player accordingly benefits from the same degree of protection afforded by a conventional hockey glove, but the hockey glove of the present invention provides significantly greater flexibility at the joints of the fingers.

The present invention thus provides a protective glove for sports comprising a flexible palm portion affixed to a padded back portion, the palm portion extending to a plurality of finger stalls, one or more of the finger stalls comprising an integral portion secured to the padded back portion and an isolated portion forming a sheath isolated from the padded portion, and means for resiliently connecting the isolated portion to the padded portion, whereby when the finger stall is flexed at an intermediate point the padded portion attached thereto remains in close proximity to the isolated portion but a gap therebetween increases, and when the finger stall is extended the gap decreases.

BRIEF DESCRIPTION OF THE DRAWINGS

In drawings which illustrate by way of example only a preferred embodiment of the invention.

DETAILED DESCRIPTION OF THE INVENTION

Figure 1:
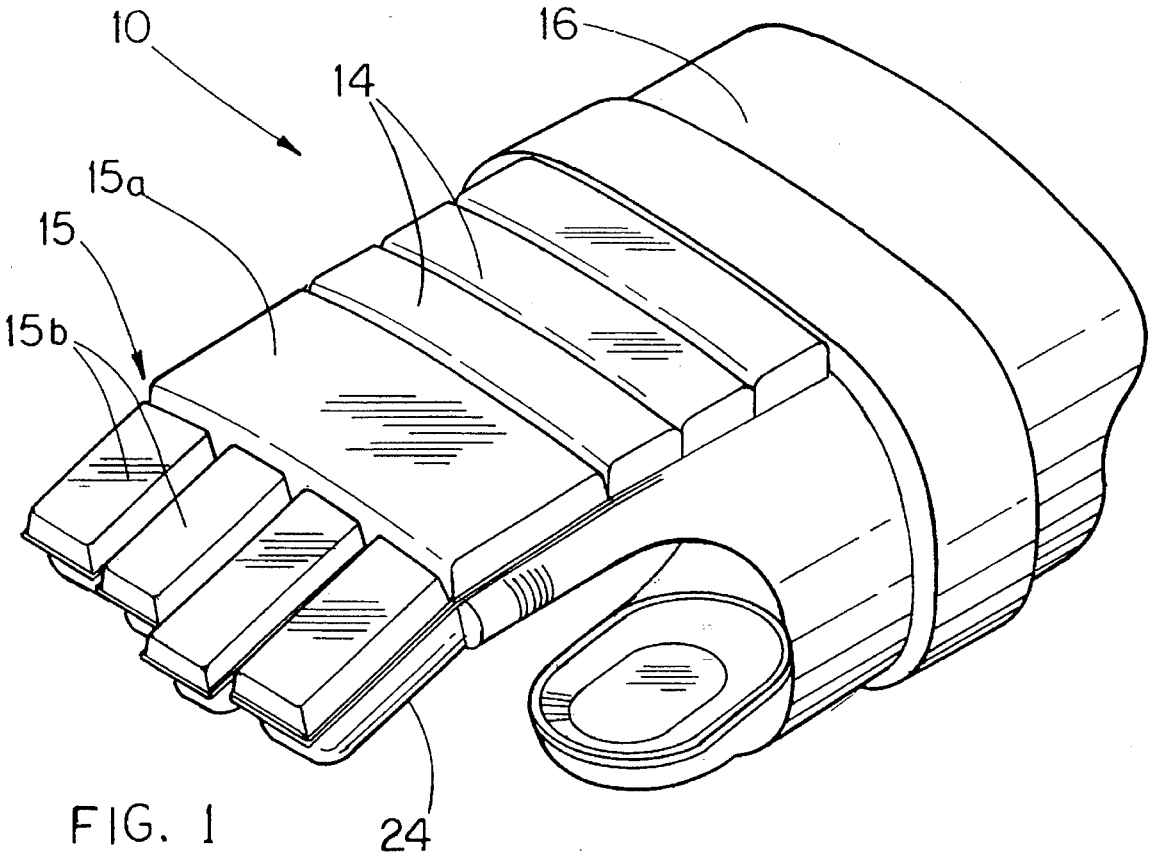
FIG. 1 is a perspective view of a protective glove embodying the invention showing the fingers fully extended.
Figure 2:
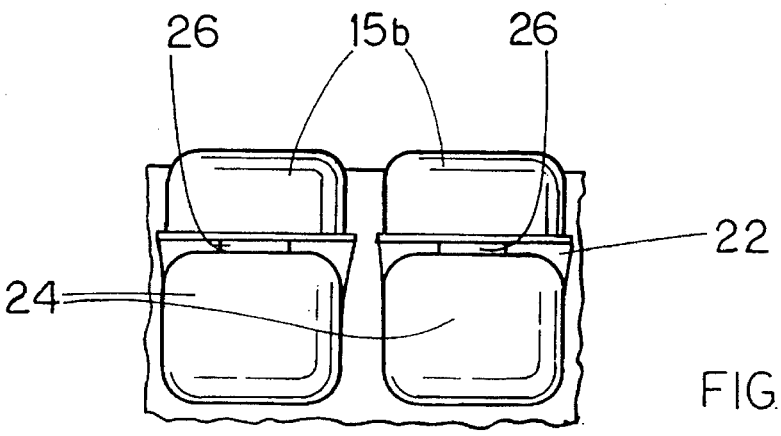
FIG. 2 is an enlarged partial end view of two fingers showing the elastic strap in the glove of FIG. 1.

Referring to FIG. 1, a protective glove such as a hockey glove 10 comprises a flexible palm portion 12 sewed to a padded back portion 14. A padded section 15 overlays the back of each finger, which may be separated into two portions 15*a* and 15*b* at about the proximal-medial joint of the finger. A protective wrist cuff 16 extends rearwardly from the padded back portion 14 and enshrouds the player's wrist during play. The palm portion 12 may be made of leather or any other suitable flexible material, and the padding is conventionally composed of a resilient foam encased in vinyl or the like. Plastic protective plates may optionally be fitted into the cuff 16 or padded portions 14, 15 for additional protection, as is conventional.

It will be appreciated that the glove of the invention is referred to as a hockey glove, the sport of hockey being its most popular application, however the glove is equally suitable for other sports, for example lacrosse, and the positioning of padding and protective plates can be adapted accordingly. Reference to the glove of the invention as a hockey glove is for convenience only, and is in no way intended to limit the invention. Similarly, the invention is described and illustrated with reference to its structure and operation in connection with the finger stalls of a hockey glove. Those skilled in the art will appreciate that the invention could equally be applied to the thumb, although because the thumb does not have a medial-distal joint this is less important than for the fingers.

The palm portion 12 of the glove 10 extends to the finger stalls 20 and is preferably cut from the same blank of material. The finger stalls 20 each comprise two parts: an integral portion 22 which is sewn in conventional fashion to the edges of the vinyl encasing the padding 14, 15 and extends approximately along the length of the proximal phalange of the finger, and an isolated portion 24 which forms a sheath around approximately the medial and distal phalanges of the finger. Thus, the isolated portion 24 of the finger stall 20 is detached from the padding 14, 15 and there is a small gap between the isolated portion 24 and the overlying padding.

Figure 4:
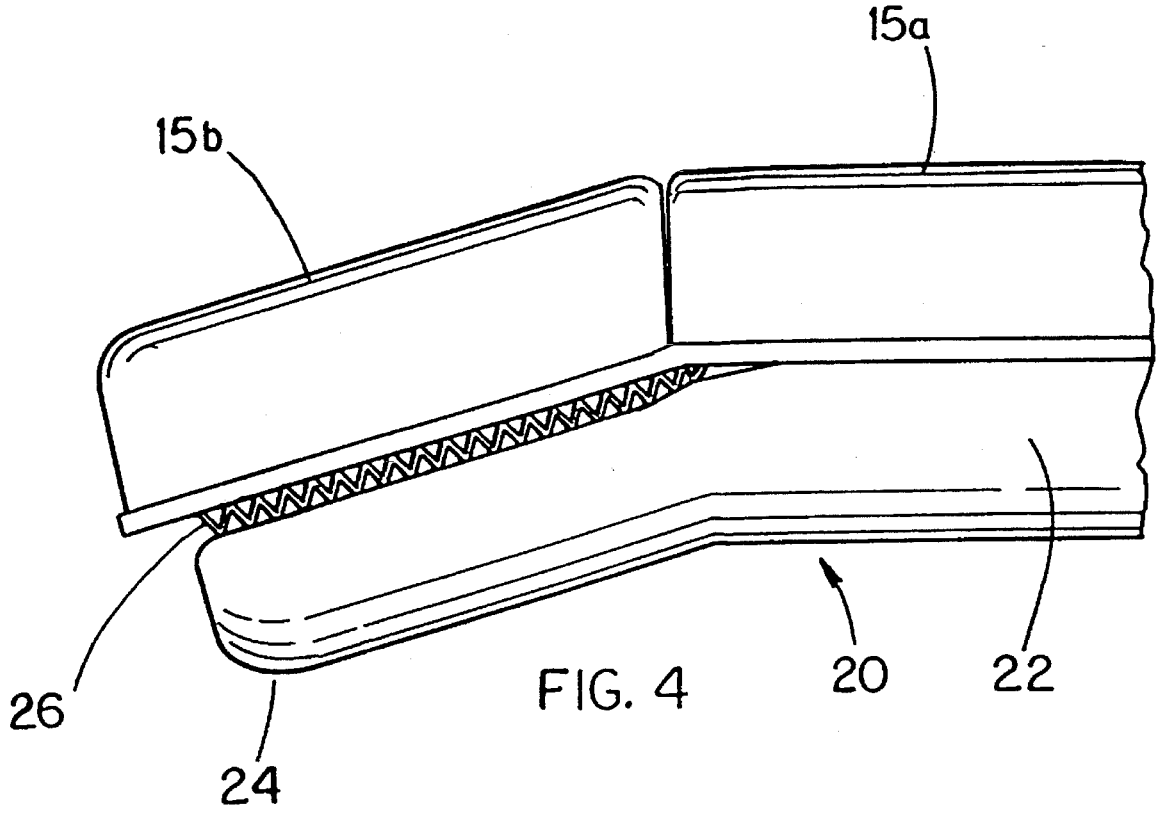
FIG. 4 is an enlarged side elevation of one extended finger in the glove of FIG. 1.

An elastic strap 26 is attached to points along the back of the isolated portion 24 of the finger stall 20 and along points of the underside of the padded sections 15. Preferably the elastic strap 26 is sewn or otherwise fastened to the finger stall 20 and the padding in a zig-zag pattern, as shown in FIG. 4, resulting in a pleated appearance. This provides a resilient web connecting the isolated portion 24 and the padding 15 which extends substantially along the length of the isolated portion 24. The elastic strap 26 should be durable enough to withstand repeated stretching, but should be as slender as possible to minimize the gap between the isolated portion 24 and the underside of the padding 15.

FIG. 1 illustrates the hockey glove of the invention with the fingers fully extended. The padded section **15*b* overlaying the distal and medial phalanges of each finger is retained in close proximity to the isolated portion 24 of the finger stall 20 by the elastic strap 26, as seen in enlarged view in FIG. 4. To ensure that the padded sections 15*b* remain in position along the back of each finger when extended, the elastic strap 26 should be attached so that it is taut in this position and not relaxed at any point along the isolated portion 24 of the finger stall 20**.

Figure 3:
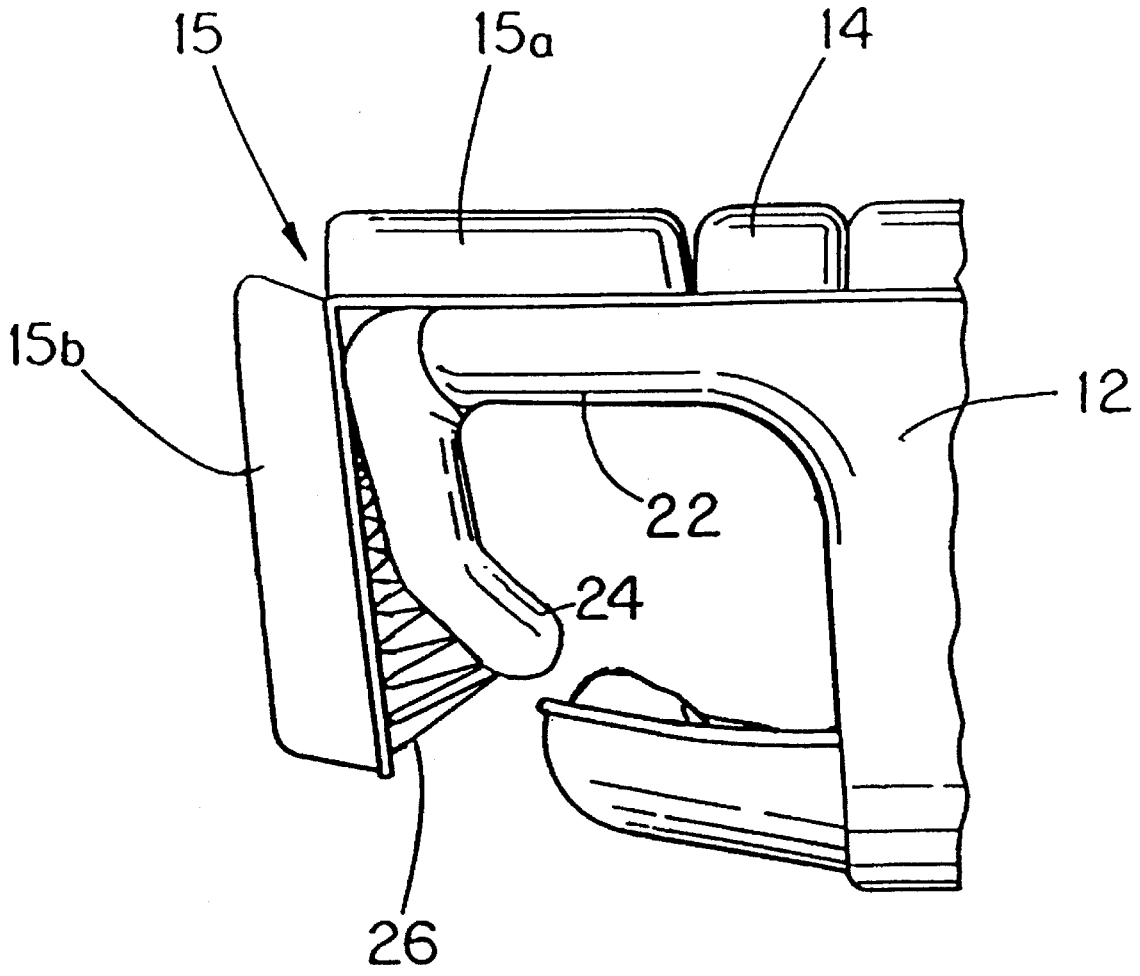
FIG. 3 is a side elevation of the glove of FIG. 1 showing the fingers substantially flexed.

In FIG. 3 the same glove is shown with the fingers flexed, as for example when gripping an object such as a hockey stick. It can be seen that the gap between the isolated portion 24 of the finger stall 20 and the padding **15*b* has generally increased, with the gap widening toward the tip of the finger. The padding 15*b* still largely overlays the medial and distal portions of the finger, and thus provides the required degree of protection. However, the ability to pull the isolated portion 24 slightly away from the padding 15*b*** when flexing the finger substantially increases the freedom of movement of the finger and thus the player's dexterity and grasping ability.

The amount of additional flexibility permitted by the invention depends upon the elasticity of the elastic strap 26 and the number of points along the finger stall 20 and the padding **15*b* to which it is affixed. The padding 15*b* must not be permitted to lag behind the finger stall 20 too far, or the protection afforded by the padding 15*b* will be diminished. FIG. 3 is slightly exaggerated for purposes of illustration, and in practise the gap between the isolated portion 24 and the padding 15** should preferably be less than 1 cm even when the finger is completely flexed.

A preferred embodiment of the invention having been thus described by way of example, it will be apparent to those skilled in the art that certain adaptations and modifications may be made without departing from the scope of the invention, as set out in the appended claims.

I claim:

1. A protective glove for sports comprising a flexible palm portion affixed to a padded back portion, the palm portion extending to a plurality of finger stalls and the padded portion extending to a plurality of padded sections overlaying the finger stalls, at least one of the finger stalls comprising an integral portion secured to the padded back portion and integral therewith to form a portion of the finger stall, and an isolated portion closed to form a sheath isolated from the padded section such that a gap is created between the isolated portion and the padded section, and an elastic strap for connecting the isolated portion to the padded section, whereby when the finger stall is flexed at an intermediate point the padded section connected to the isolated portion remains in close proximity to the isolated portion but the gap therebetween increases, and when the finger stall is extended the gap decreases.

2. The protective glove of claim 1 in which the strap is fastened along the padded section at a plurality of points.

3. The protective glove of claim 2 in which the strap is fastened along the isolated portion at a plurality of points.

4. The protective glove of claim 3 in which the strap extends between the padded section and the isolated portion in a zig-zag pattern.

5. The protective glove of claim 1 in which all of the finger stalls are provided with an isolated portion.

6. The protective glove of claim 1 in which the isolated portion extends substantially along the length of the medial and distal portion of a finger.

7. The protective glove of claim 1 in which the palm portion is sewn to the padded back portion.

8. The protective glove of claim 1 in which the resilient means is sewn to the padded section and to the isolated portion.

9. The protective glove of claim 3 in which the elastic strap is sewn to the padded section and to the isolated portion.

* * * * *